US007654012B2

(12) United States Patent
Kelley

(10) Patent No.: US 7,654,012 B2
(45) Date of Patent: Feb. 2, 2010

(54) CLOSURE DEVICE FOR SHOE

(75) Inventor: Scott Kelley, Torrance, CA (US)

(73) Assignee: Skechers U.S.A., Inc. II, Manhattan Beach, CA (US)

( * ) Notice: Subject to any disclaimer, the term of this patent is extended or adjusted under 35 U.S.C. 154(b) by 407 days.

(21) Appl. No.: 11/532,332

(22) Filed: Sep. 15, 2006

(65) Prior Publication Data

US 2008/0066344 A1 Mar. 20, 2008

(51) Int. Cl.
*A43C 11/00* (2006.01)

(52) U.S. Cl. ..... 36/50.1; 36/138

(58) Field of Classification Search ..... 36/50.1, 36/138, 50.5, 88, 89, 90; D2/972, 969
See application file for complete search history.

(56) References Cited

U.S. PATENT DOCUMENTS

| | | | | |
|---|---|---|---|---|
| 145,776 | A | 12/1873 | Babbitt | |
| 177,396 | A * | 5/1876 | Harris | 36/50.1 |
| 796,258 | A | 8/1905 | Scott | |
| D64,104 | S | 2/1924 | Kezy | |
| D94,755 | S | 3/1935 | Grossman | |
| 2,071,593 | A | 2/1937 | Thormann | |
| 4,130,949 | A | 12/1978 | Seidel | |
| 4,282,659 | A | 8/1981 | Bourque | |
| 4,845,864 | A | 7/1989 | Corliss | |
| 4,901,451 | A | 2/1990 | Cumin | |
| D325,290 | S | 4/1992 | Hatfield | |
| D341,703 | S | 11/1993 | Hatfield | |
| D342,600 | S | 12/1993 | Hatfield | |
| 5,269,078 | A | 12/1993 | Cochrane | |
| D342,821 | S | 1/1994 | Avar | |
| D343,277 | S | 1/1994 | Richard | |
| D345,247 | S | 3/1994 | Bailey | |
| 5,317,820 | A | 6/1994 | Bell | |
| 5,392,535 | A | 2/1995 | Van Noy | |
| D358,021 | S | 5/1995 | Vestuti | |
| D360,520 | S | 7/1995 | Bailey | |
| D365,438 | S | 12/1995 | Orzeck | |
| 5,471,769 | A | 12/1995 | Sink | |
| 5,659,982 | A * | 8/1997 | Muraoka et al. | 36/131 |
| D387,893 | S | 12/1997 | Bathum | |
| 5,775,006 | A | 7/1998 | Breuner | |
| 6,270,468 | B1 | 8/2001 | Townsend | |
| D473,702 | S | 4/2003 | Burg | |
| D486,298 | S | 2/2004 | Adams | |
| 6,694,641 | B1 | 2/2004 | Gill | |
| 6,757,991 | B2 * | 7/2004 | Sussmann | 36/50.1 |
| 6,775,929 | B2 | 8/2004 | Katz | |
| 6,792,702 | B2 | 9/2004 | Borsoi | |
| D511,609 | S | 11/2005 | Magro | |
| D513,361 | S * | 1/2006 | Teriatnikov | D2/969 |
| D514,788 | S * | 2/2006 | Schoenborn et al. | D2/969 |
| D520,223 | S | 5/2006 | Burg | |
| D532,962 | S | 12/2006 | Teteriatnikov | |

(Continued)

FOREIGN PATENT DOCUMENTS

| | | |
|---|---|---|
| FR | 2615074 | 11/1988 |

*Primary Examiner*—Ted Kavanaugh
(74) *Attorney, Agent, or Firm*—Marshall A. Lerner; Marvin H. Kleinberg; Kleinberg & Lerner, LLP

(57) ABSTRACT

The present invention provides a fitted, supportive, comfortable shoe upper with a laceless closure device comprising one interlaced strap capable of rapid adjustment in multiple planes of movement.

4 Claims, 3 Drawing Sheets

U.S. PATENT DOCUMENTS

D536,866 S * 2/2007 Cass ..... D2/972
D541,515 S 5/2007 Lane
D563,639 S * 3/2008 Matis et al. ..... D2/969
2007/0063459 A1 3/2007 Kavarsky
2008/0086910 A1 4/2008 Kim

* cited by examiner

CLOSURE DEVICE FOR SHOE

BACKGROUND OF THE INVENTION

1. Field of the Invention

The present invention relates to footwear, more particularly to a laceless shoe upper closure device with adjustability.

2. Description of the Related Art

The modern consumer of sport footwear expects a comfortable, supportive, functional, tastefully ornamented product. Footwear designers have responded with products combining new materials and performance engineering features. The adoption of alternative closure mechanisms to the conventional shoe lace has lead to the use of straps, buckles, and other innovations to adapt the shoe upper to the individual end users foot and to allow for quicker fitting and removing of a shoe. The present invention relates to a laceless shoe upper closure device capable of being adjusted to better fit the end users foot.

Prior art closure mechanisms have included the conventional shoe lace system, multi-strap devices, and other variants. Attempts have been made to improve the closure mechanisms by using an adjustable, single strap design, closure device.

The conventional shoe lace has been used for fastening the shoe upper for numerous years with great success. The use of multiple holes found in the eyerow has allowed for adjustability of the shoe upper to fit the end users foot leading to a comfortable fit. The disadvantage of the conventional shoe lace is that it requires an excessive amount of time for adjustment. The shoe laces need to be individually loosed for removal of the shoe and individually fastened starting from the bottom of the shoe eyerow to the top when lacing the shoe upper. Furthermore, if at any given time the shoe upper needs to be adjusted for better comfort, all laces, above the point at which the adjustment must be made, must be unfastened to adequately reach the point of adjustment, and refastened after the adjustment is made. In addition the shoe lace system has a tendency to unfasten itself as the knot is inadvertently undone. Often this shortcoming is relieved by fastening a double knot, which further adds to the time and effort necessary if the user wants to make an adjustment to the shoe upper, and during fastening and removal of the shoe.

The prior art strap device shoes incorporate the use of multiple independent straps positioned horizontally across the upper of the shoe allowing for the end user to insert the user's foot into the shoe with the straps in the relaxed or open position. Once the foot is inserted, the independent straps are fitted individually to encompass the foot in a comfortable and supportive shoe. The prior art strap device shoe is hindered by the fact that the end user has to adjust multiple straps in order to get the precise fit most comfortable to the end user. The adjustment of the straps, although far more efficient than shoe laces, requires additional time and constant readjustment to maintain the level of comfort and support required in an athletic shoe. Furthermore, the placement of the straps in the horizontal position limits the plane of adjustability in the straps to a uni-dimensional horizontal plane. The human foot is by far one of the most distinct and non-homologated features of the human body. As such, the demand to provide a shoe capable of adjustment in multiple planes is a necessity in providing support and comfort.

The present invention aims to provide a shoe upper closure device consisting of one interlaced strap capable of adjustment in at least two-planes. The use of a single strap allows the end user to adjust, fasten and remove the shoe much more effectively and efficiently. The interlaced strap connected to adjustable d-rings ensures the end users foot is sufficiently supported in the shoe and held into place in at least two planes, leading to a supportive, comfortable housing for the athletic foot.

SUMMARY OF THE INVENTION

It is the object of the present invention to provide a shoe upper with a laceless closure device comprising one interlaced strap capable of adjustment in multiple planes of movement.

In accordance with this object and others which will be described and which will become apparent, a preferred exemplary embodiment of a shoe upper in accordance with the present invention includes a shoe upper with an interlaced strap, d-ring attachments and a fastening mechanism.

The interlaced strap is attached to the medial portion of the shoe upper adjacent to the lower portion of the shoe tongue, hereinafter referred as the lower fixed point. The interlaced strap has a second medial attachment point at the upper portion of the shoe adjacent to the tongue, hereinafter referred as the upper fixed point. The shoe upper contains a lateral d-ring and a medial d-ring offset from one another in the vertical plane. Both d-rings are fastened to the shoe upper and allow the interlaced strap to move freely.

From the lower fixed point the interlaced strap weaves through the lateral d-ring across the lower portion of the tongue of the shoe upper, thereabout the interlaced strap moves across the mid-section of the tongue to the medial d-ring, and finally attaching to the medial portion of the shoe upper at the upper affixed point. An adjustable d-ring is positioned on the interlaced strap between the medial d-ring and upper attachment point. A fastening mechanism is attached to the adjustable d-ring. The adjustable d-ring can move freely along the interlaced strap between the medial d-ring and upper fixed point. The fastening mechanism, which may be comprised of Velcro, adjustable buttons, a click-lock mechanism or any other suitable fastening mechanism, is matted to a receiving portion of the fastening mechanism at the upper lateral portion of the shoe upper adjacent to the tongue.

The adjustability of the interlaced strap at each d-ring attachment point allows for a multitude to varying fitments accommodating the end users foot. The placement of the d-rings, lower fixed point, upper fixed point and fastening mechanism receiving portion adjacent to the tongue assures the greatest degree of adjustability in the upper of the shoe while maintaining the structural integrity and supportive element of the shoe.

Closure of the shoe is accomplished by pulling upward upon the fastening member. The d-ring attached to the fastening member allows for the even distribution of force on the interlaced strap allowing the strap to tighten evenly throughout the shoe upper. The medial d-ring and lateral d-ring further distribute the force applied when the user pulls up on the fastening member evenly on the lower and mid-section of the shoe upper. The upper portion of the shoe upper remains taut as the fastening member is brought across the tongue of the shoe from the medial to lateral portion of the shoe, while maintaining force upon the fastening mechanism. While retaining even force, the fastening member is attached to the fastening member receiving portion which maintains the snug, supportive, and comfortable function of the closure device.

The closure route established by the interlaced strap commences at the lower fixed point where the interlaced strap is permanently attached to the shoe upper. The interlaced strap wraps across the shoe tongue to the lateral d-ring. Thereafter the interlaced strap wraps across the mid-section of the tongue to the medial d-ring, and once again across the tongue to the fastening mechanism which has been attached to the fastening mechanism receiving portion. The interlaced strap crosses the upper portion of the tongue for the forth time to thereby apply force across the top of the shoe upper assuring a snug, secure housing for the wearer's foot.

The position of the second and third crossing of the shoe tongue by the interlaced strap is designed to evenly disperse the force of the interlaced strap across the wearer's foot effectively providing the greatest amount of support. The fastening member and respective fastening member receiving portion is capable of quick adjustment and re-adjustment leading to a supportive shoe that has the capability of adjustment with minimal time and effort.

BRIEF DESCRIPTION OF THE DRAWINGS

For a further understanding of the objects and advantages of the present invention, reference should be had to the following detailed description, taken in conjunction with the accompanying drawing, in which like parts are given like reference numbers and wherein.

DESCRIPTION OF THE PREFERRED EMBODIMENTS

Figure 1:
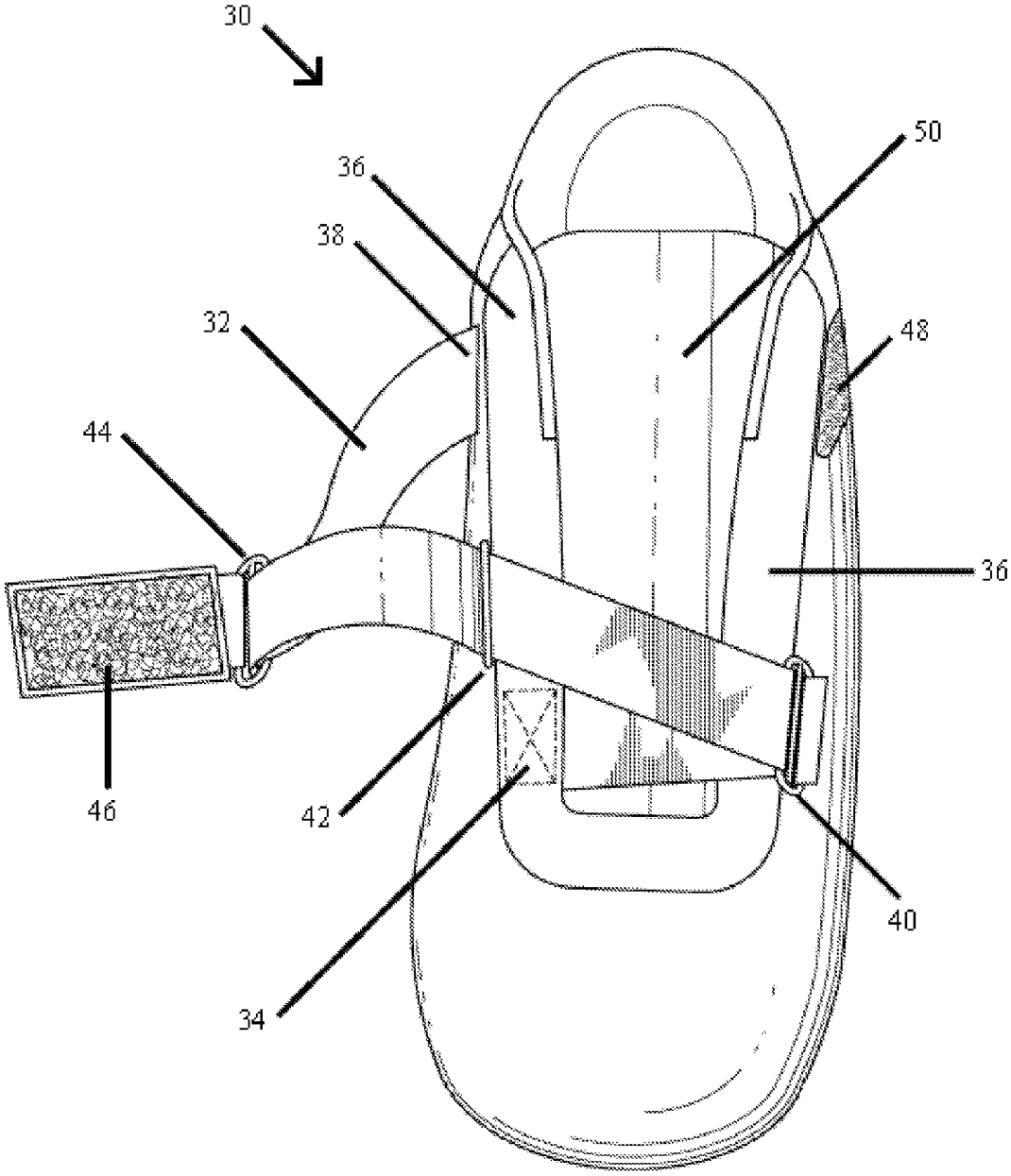
FIG. 1 is a top view of the shoe upper with the interlaced strap in the open position, in accordance with the present invention.

The invention will now be described with reference to FIG. 1, which illustrates a top view of the preferred embodiment of a shoe upper portion in accordance with the present invention. As shown in FIG. 1, a shoe upper 30 has a u-shaped member 36 and a tongue 50 spanning below the u-shaped member 36. In a conventional shoe the u-shaped member 36 would have an eyerow which would contain numerous openings for the passage of shoe laces. The present invention contains an interlaced strap 32 positioned to encompass the u-shaped member 36. The interlaced strap 32 is connected at the bottom of the u-shaped member 36 at the lower fixed point 34 found on the medial side of the shoe upper 30. The interlaced strap 32 crosses the u-shaped member 36 to the lateral d-ring 40 across the tongue 50, back across the tongue 50 to the medial d-ring 42, through the adjustable d-ring 44 and attaches to the shoe upper at the upper fixed point 38.

With further reference to FIG. 1, the adjustable d-ring 44 is attached to the fastening mechanism 46, which attaches to the lateral side of the shoe upper 30 at the fastening mechanism receiving point 48.

With additional reference to FIG. 1, the lateral d-ring 40, medial d-ring 42, and adjustable d-ring 44 are freely adjustable allowing the interlaced strap 32 to be fitted to the individual wearer's foot.

Figure 2:
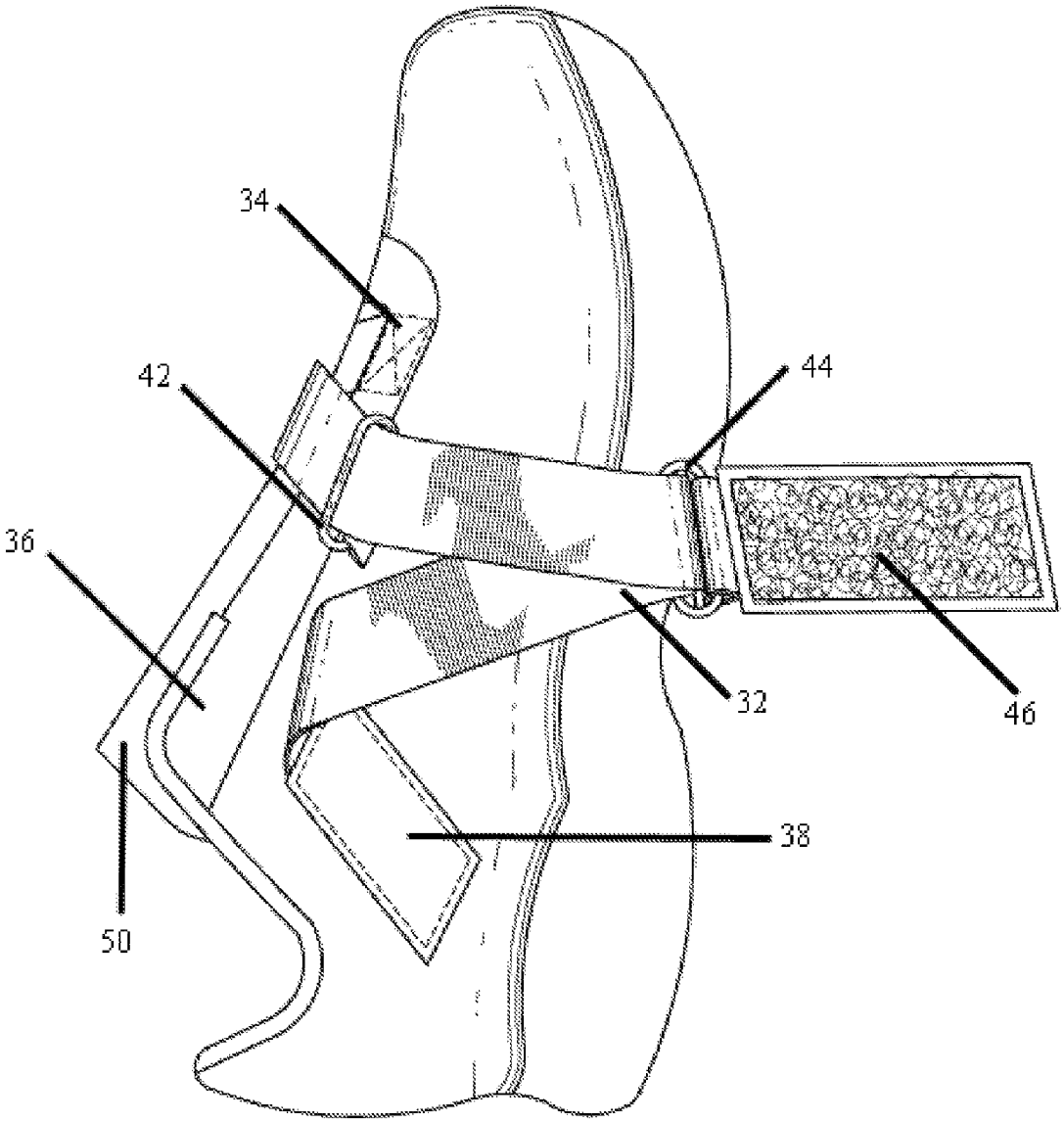
FIG. 2 is a medial side elevational view of the shoe upper with the interlaced strap in the open position.

With reference to FIG. 2, the medial side elevated view of the shoe upper 30 shows the interlaced strap 32 in the open position, depicting the fastening mechanism 46 attached to the adjustable d-ring 44, the interlaced strap running through the medial d-ring 42, across the u-shaped member 36 and tongue 50 of the shoe upper 30. The lower fixed point 34 and upper fixed point 38 are permanently attached to the medial side of the shoe upper 30.

With further reference to FIG. 2, the adjustable d-ring 44 can be seen permanently attached to the fastening mechanism 46, and the interlaced strap 32 is connected to the adjustable d-ring 44 which is capable of free movement along the interlaced strap 32 between the medial d-ring 42 and upper affixed point 38.

Figure 3:
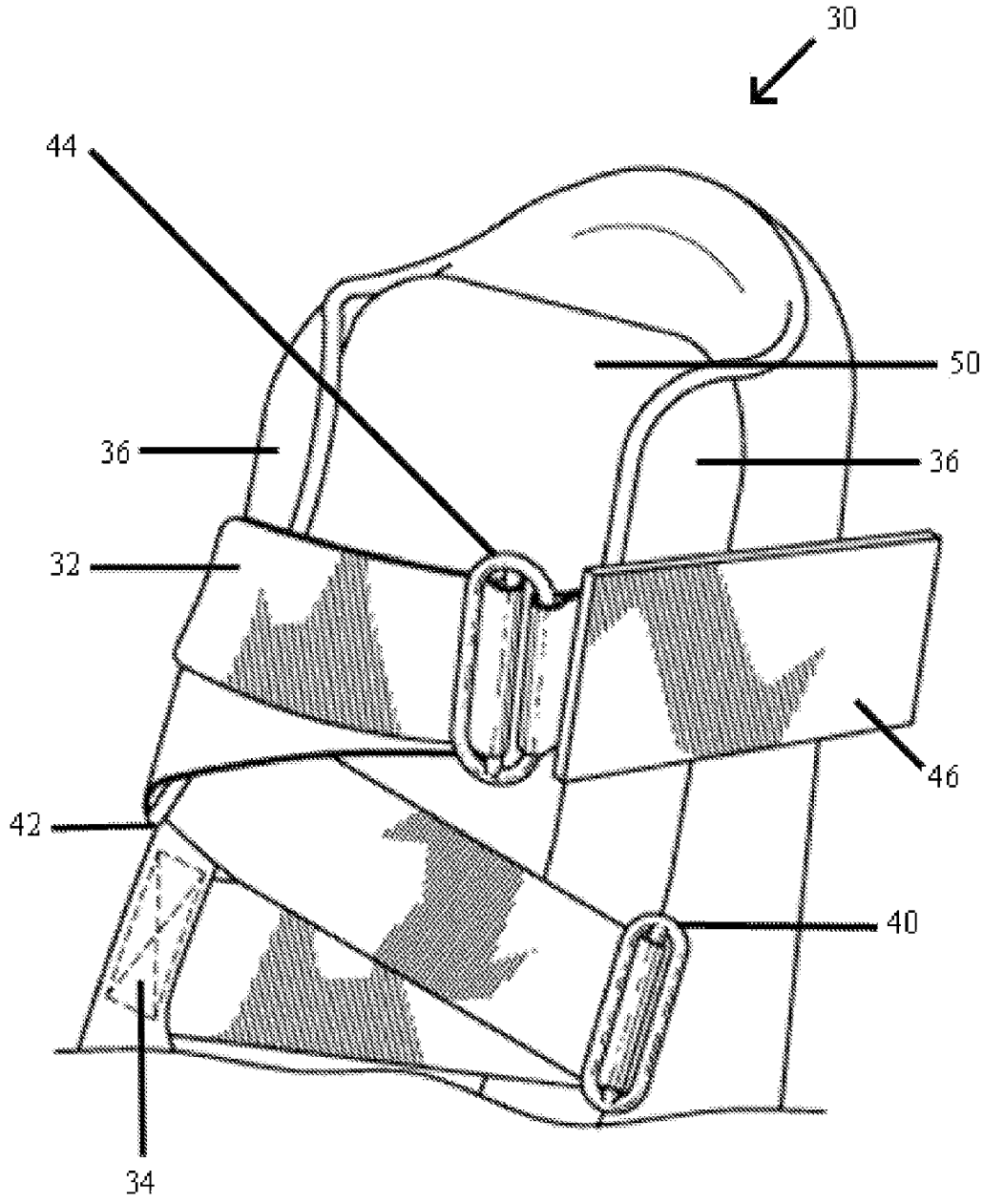
FIG. 3 is a front perspective view of a portion of the shoe upper with the interlaced strap in the closed position.

FIG. 3 shows the partial view of the front perspective of the shoe upper 30 with the interlaced strap 32 in the closed position. The lateral d-ring 40, medial d-ring 42, and adjustable d-ring 44 have additional friction placed upon them due to the configuration of the interlaced strap 32 in the closed position. The fastening mechanism 46 has been matted to the fastening mechanism receiving point 48 creating the taut, supportive cocoon for the end user's foot.

With further reference to FIG. 3, the shoe upper 30 has a u-shaped member 36 and a tongue 50, which is supportively encompassed by the interlaced strap 32 to provide a snug supportive covering for the wearer's foot. The interlaced strap 32 is connected at the bottom of the u-shaped member 36 at the lower fixed point 34, on the medial side of the shoe upper 30. The interlaced strap 32 crosses the u-shaped member 36 to the lateral d-ring 40 across the u-shaped member 36. The interlaced strap 32 then continues back across the u-shaped member 36 to the medial d-ring 42, and through the adjustable d-ring 44 which is permanently connected to the fastening mechanism 46.

In accordance with the preset invention, the shoe is closed by pulling upon the fastening mechanism 46 to establish a snug, supportive, comfortable housing for the wearer's foot. The lateral d-ring 40, medial d-ring 42, and adjustable d-ring 44 are freely adjustable allowing for the even distribution of pressure, applied by pulling the fastening mechanism 46, across the u-shaped member 36 and tongue 50 of the shoe upper 30. The position of the lateral d-ring 40, medial d-ring 42, and adjustable d-ring 44 in the open position is such that minimal friction is exerted upon the d-ring pulley's allowing for ease of movement of the interlaced strap 32. While force is maintained upon the fastening mechanism 46, retaining the snug, supportive, comfortable housing, the fastening mechanism 46 is directed towards the fastening mechanism receiving portion 48. By pulling on the fastening mechanism 46, the user increases the amount of force on the lateral d-ring 40, medial d-ring 42, and adjustable d-ring 44, thereby maintaining the interlaced strap 32 taut, and attaching the fastening mechanism 46 to the fastening mechanism receiving portion 48.

While the foregoing detailed description sets forth exemplary embodiments of a shoe upper portion in accordance with the present invention, it is to be understood that the above description is illustrative only and not limiting of the disclosed invention. Indeed, it will be appreciated that the embodiment discussed above and the virtually infinite embodiments that are not mentioned could easily be within the scope and spirit of the present invention. Thus, the present invention is to be limited only by the claims as set forth below.

What is claimed is:

1. A shoe comprising a shoe upper, a tongue, and a closure device, said closure device comprising:

a strap fixedly attached at one end of said strap to the shoe upper at a location adjacent to a side of the tongue, the other end of the strap fixedly attached to the shoe upper at a location adjacent to the same side of the tongue;

a plurality of ring means, the strap being threaded through said plurality of ring means;

said plurality of ring means comprising a first ring means, said first ring means fixedly attached to the shoe upper at a location on the opposite side of the tongue from the side of the tongue adjacent to the location where the strap is fixedly attached to the shoe upper;

said plurality of ring means further comprising a second ring means, said second ring means fixedly attached to the shoe upper at a location on the same side of the tongue as the side of the tongue adjacent to the location where the strap is fixedly attached to the shoe upper;

said plurality of ring means further comprising a third ring means, said third ring means fixedly attached to a fastening mechanism; and said fastening mechanism being removably attachable to the shoe upper.

2. A shoe as set forth in claim 1 wherein said third ring means is an adjustable d-ring.

3. A shoe comprising a shoe upper, a tongue, and a closure device, said closure device comprising:

a strap fixedly attached at one end of said strap to the shoe upper at a location adjacent to a side of the tongue, the other end of the strap fixedly attached to the shoe upper at a location adjacent to the same side of the tongue;

a plurality of ring means, the strap being threaded through said plurality of ring means;

said plurality of ring means comprising a first ring means, said first ring means fixedly attached to the shoe upper at a location on the opposite side of the tongue from the side of the tongue adjacent to the location where the strap is fixedly attached to the shoe upper;

said plurality of ring means further comprising a second ring means, said second ring means fixedly attached to the shoe upper at a location on the same side of the tongue as the side of the tongue adjacent to the location where the strap is fixedly attached to the shoe upper;

a fastening mechanism removably attached to the shoe upper; and wherein said fastening mechanism is fixedly attached to an adjustable ring means and said adjustable ring means is attached to the strap.

4. A shoe asset forth in claim 3 wherein said adjustable ring means is an adjustable d-ring.

* * * * *

UNITED STATES PATENT AND TRADEMARK OFFICE

CERTIFICATE OF CORRECTION

PATENT NO. : 7,654,012 B2
APPLICATION NO. : 11/532332
DATED : February 2, 2010
INVENTOR(S) : Scott Kelley It is certified that error appears in the above-identified patent and that said Letters Patent is hereby corrected as shown below:

At column 6, Ln 18, Claim 4, the word "asset" should be corrected to, "as set"

Signed and Sealed this

Sixth Day of April, 2010

David J. Kappos

David J. Kappos
*Director of the United States Patent and Trademark Office*